US005284440A

United States Patent [19]

Campbell, Jr. et al.

[11] Patent Number: 5,284,440

[45] Date of Patent: Feb. 8, 1994

[54] WATER-COOLED, WORKPIECE-SUPPORTING MEMBERS FOR A HEATING FURNACE

[75] Inventors: Frank Campbell, Jr., Houston, Tex.; Hugh J. Harding, McMurray, Pa.

[73] Assignee: SSE International Corporation, Bridgeville, Pa.

[21] Appl. No.: 905,303

[22] Filed: Jun. 29, 1992

[51] Int. Cl.[5] ..... F27D 3/00

[52] U.S. Cl. ..... 432/127; 432/234; 432/236

[58] Field of Search ..... 432/127, 128, 234, 236

[56] References Cited

U.S. PATENT DOCUMENTS 3,387,834 6/1968 Bricmont et al. ..... 432/127
3,642,261 2/1972 Laws ..... 432/234
3,647,194 3/1972 Brungraber et al. ..... 432/234
3,687,427 8/1972 Mori et al. ..... 432/234
4,386,630 6/1983 Grapinski ..... 432/234
4,936,771 6/1990 Sidwell ..... 432/127
5,232,359 8/1993 Campbell et al. ..... 432/234

*Primary Examiner*—Henry C. Yuen
*Attorney, Agent, or Firm*—Harry B. Keck

[57] ABSTRACT

Tall work-supporting elements, riders or buttons, for reheat furnaces increase the unshadowed area of radiation exposure for the under surface of steel workpieces and thereby significantly reduce the "skid mark" phenomena of workpieces. The tall supporting members are secured to horizontal water-cooled skids and have internal flow passageways to receive cooling water.

8 Claims, 5 Drawing Sheets

WATER-COOLED, WORKPIECE-SUPPORTING MEMBERS FOR A HEATING FURNACE

BACKGROUND OF THE INVENTION

Field of the Invention—This invention concerns water-cooled, workpiece-supporting members for use in heating furnaces for steel workpieces and, more particularly, to improved riders and buttons for use in pusher furnaces, in walking beam furnaces, and in composite furnaces.

Description of the Prior Art—Reheat furnaces for steel workpieces are typically pusher furnaces (U.S. Pat. Nos. 3,148,868; 4,540,364; 4,427,371), walking beam furnaces (U.S. Pat. Nos. 3,749,550; 4,290,752), or, composite furnaces (U.S. patent application Ser. No. 874,393 filed Apr. 27, 1992). Each of these furnaces provides a series of lengthwise supports, frequently called skids, with workpiece-supporting members secured to the top thereof for supporting steel workpiece in their movement through the reheat furnace. The workpieces are usually steel slabs 9 to 10 inches thick, 30 to 82 inches wide and 30 to 40 feet long. The workpieces are heated from ambient temperatures to final temperatures of 2100° to 2500° F. depending upon the steel and the intended use of the steel.

Pusher Furnaces—The workpiece supporting members in pusher furnaces are called riders and are secured to the top of lengthwise support members, frequently hollow conduits containing water for the purpose of cooling the skid and cooling the rider (U.S. Pat. Nos. 4,354,824; 4,601,659). Workpieces are abutted front-to-back in the pusher furnace and are advanced through the pusher furnace supporting on the riders. As a fresh steel workpiece is introduced into the charging end of a pusher furnace, a corresponding heated steel workpiece is extracted from the discharge end of the furnace for rolling mill treatments or other processing. Riders typically are 3 to 5 inches high.

Walking Beam Furnaces—A typical walking beam furnace has multiple horizontal lengthwise skids which are securely fixed with respect to the furnace and has intermediate lengthwise horizontal skids (the walking skids) which are equipped to rise upwardly, advance forwardly, withdraw downwardly and return to the original position. The fixed skids and the walking skids are equipped with spaced-apart buttons which are secured to the skid and extend vertically upwardly to support and engage steel workpieces throughout the length of the furnace (U.S. Pat. Nos. 4,609,347; 4,906,525). Relatively tall buttons greater than 120 mm have been proposed (U.S. Pat. No. 4,747,775). The fixed skids and walking skids are frequently hollow pipes through which water flows to maintain a low temperature for the skids and the buttons (U.S. Pat. Nos. 4,687,027; 4,293,299; 4,591,340).

Composite Furnace—A composite steel workpiece reheat furnace is described in co-pending patent application Ser. No. 874,393 filed Apr. 27, 1992 by Frank Campbell and Hugh J. Harding. The composite furnace is a pusher furnace adjacent the charging end and becomes a walking beam furnace adjacent the discharge end. The composite furnace employs riders to support steel workpieces in the pusher portion and employs buttons secured to the fixed skids and walking skids in the walking beam portion of the reheat furnace.

Skid Marks—A serious concern of steel manufacturers is the consequence of skid marks on steel workpieces which are produced in steel reheat furnaces (U.S. Pat. Nos. 5,007,824; 4,884,967; 4,936,771). Skid marks result from two principal phenomena:

1. The riders or buttons are maintained at a lower temperature than the design temperature for discharging steel workpieces. As a consequence, there is a transfer of heat from each steel workpiece conductively into the riders and buttons through the bottom, supported surface of the steel workpieces which are in contact with the top surfaces of the riders and buttons. The resulting temperature along the line of the skids is lower adjacent to the bottom surface of the steel workpiece than the workpiece temperatures throughout the body of the steel workpiece. These regions of lowered temperatures are called "skid marks" and result in differential metallurgical properties of the steel workpiece.
2. In a steel reheat furnace, radiant heat energy is directed into the steel workpiece from radiant fuel burners which may be above the steel workpieces and which may be below the steel workpieces, or both. In addition, the interior walls, ceiling and floor of the steel reheat furnaces are radiating surfaces directing and re-directing radiant heat energy toward the steel workpieces. In the regions of the buttons and riders where the straight line access of radiant energy to the undersurface of the steel workpieces is shielded by skids, buttons, riders or any other structure (e.g., cross braces connecting skids). The heat delivery to the under surface of the steel workpieces is greater between adjoining skids than at the regions above any skid. Accordingly a cooler bottom surface is presented along the line of the skids as a result of the significant shadow effect of the skids and the riders or buttons. This shadow effect coincides with the thermal conduction from the workpiece through the riders or buttons and creates regions of lower temperatures which are the "skid marks".

Numerous solutions have been proposed to reduce the skid marking tendencies of steel reheat furnaces to produce a heated steel workpiece having a generally uniform temperature profile across its bottom surface corresponding to the generally uniform temperature profile across the top of the steel workpiece. As the steel market demands increasing uniformity in sheet steel products, the steel industry is becoming more concerned about eliminating or significantly reducing the skid mark phenomenon (U.S. Pat. Nos. 5,007,824; 4,936,771; 4,884,967).

STATEMENT OF THE PRESENT INVENTION

To reduce the shadow effect of skids and risers or buttons, Applicants propose that higher buttons and riders will create smaller shadows and therefore reduce the shadow effect. Typical riders or buttons are about two to six inches above the supporting skid. The installation of taller riders or buttons results in a reduced shadow effect but permits the taller riders or buttons to increase in temperature to a level at which the taller buttons or riders wear rapidly, requiring costly, frequent replacement.

According to the present invention, tall riders and buttons are provided with hollow spaces for receiving cooling water to maintain low temperatures in the riders and buttons, thereby retaining adequate strength and wear resistance. The buttons and riders of this invention include means for securing the buttons or riders to a skid having a tubular upper member containing flowing water. A first tube is provided to deliver water from the tubular skid into the hollow space of each button or riser. A second tube is provided to withdraw liquid from the hollow space of each button or riser. In a preferred embodiment of the invention, the tubular skid pipe has an internal manifold conduit for delivering water in a flow path which is distinct and separate from the annulus between the internal manifold conduit and the tubular skid pipe. Water is delivered separately to the internal conduit and to the annulus. Water is drawn from the internal conduit through a first tube which passes through the skid annulus and through the outer wall of the tubular skid pipe into the hollow space of a button or rider. Water is withdrawn from the hollow space of a button or rider through the second tube which communicates with the skid annulus. The rate of flow of cooling water through the system is regulated to achieve the desired cooling in the buttons or riders and to preclude steam formation within the water flow system. In a preferred embodiment, the flow passageway within a button or rider includes two distinct chambers separated by a neck having a smaller effective cross-sectional area than either of the chambers. Cooling water is introduced into one chamber and accelerated through the narrow neck into the second chamber and thence withdrawn to the skid annulus.

In a further preferred embodiment, the second tube for each button or rider extends into the second chamber and terminates adjacent to the top wall of the second chamber. This construction avoids accumulation of any air pocket within open space of the rider or button. In a further embodiment, a small recess is provided in the top wall of the second chamber; the open end of the second tube is positioned within the recess.

As a result of the described water cooling features, taller buttons or riders can be employed in reheat furnaces than heretofore. The consequence is that the skids and buttons or riders present a significantly reduced shadow effect which reduces the "skid mark" phenomenon for steel workpiece passing through reheat furnaces equipped with buttons and riders according to this invention.

Interchangeable tips or top surfaces for buttons and riders is recommended to facilitate replacement of the wearing surfaces of the buttons and riders during the lifetime of the steel reheat furnace.

OBJECTS

It is an object of this invention to provide a steel reheat furnace, pusher or walking beam or composite, with tall buttons and riders to reduce the shadow effect of radiant heat transmission to the undersurface of steel workpiece in a steel reheat furnace.

It is an object of this invention to increase the vertical spacing between skid pipes and the under surface of a supported steel workpiece.

It is a further object of this invention to provide water cooled skids and water cooled riders and buttons.

It is a further object of this invention to provide water cooled skids having two separate supply means for introducing cooling water into the tubular skid and a single withdrawal means for removing cooling water from the skid.

It is an ultimate object of this invention to provide a process and apparatus for heating steel workpieces with greater temperature uniformity in the resulting heated workpiece to reduce the "skid mark" manifestations.

A further object of this invention is to lower the bulk temperature required of the steel workpieces by achieving a more uniform temperature distribution throughout the heated workpiece.

These and other objects of the invention will become apparent by reference to the accompanying drawings in which.

DESCRIPTION OF THE PREFERRED EMBODIMENTS

Figure 1:
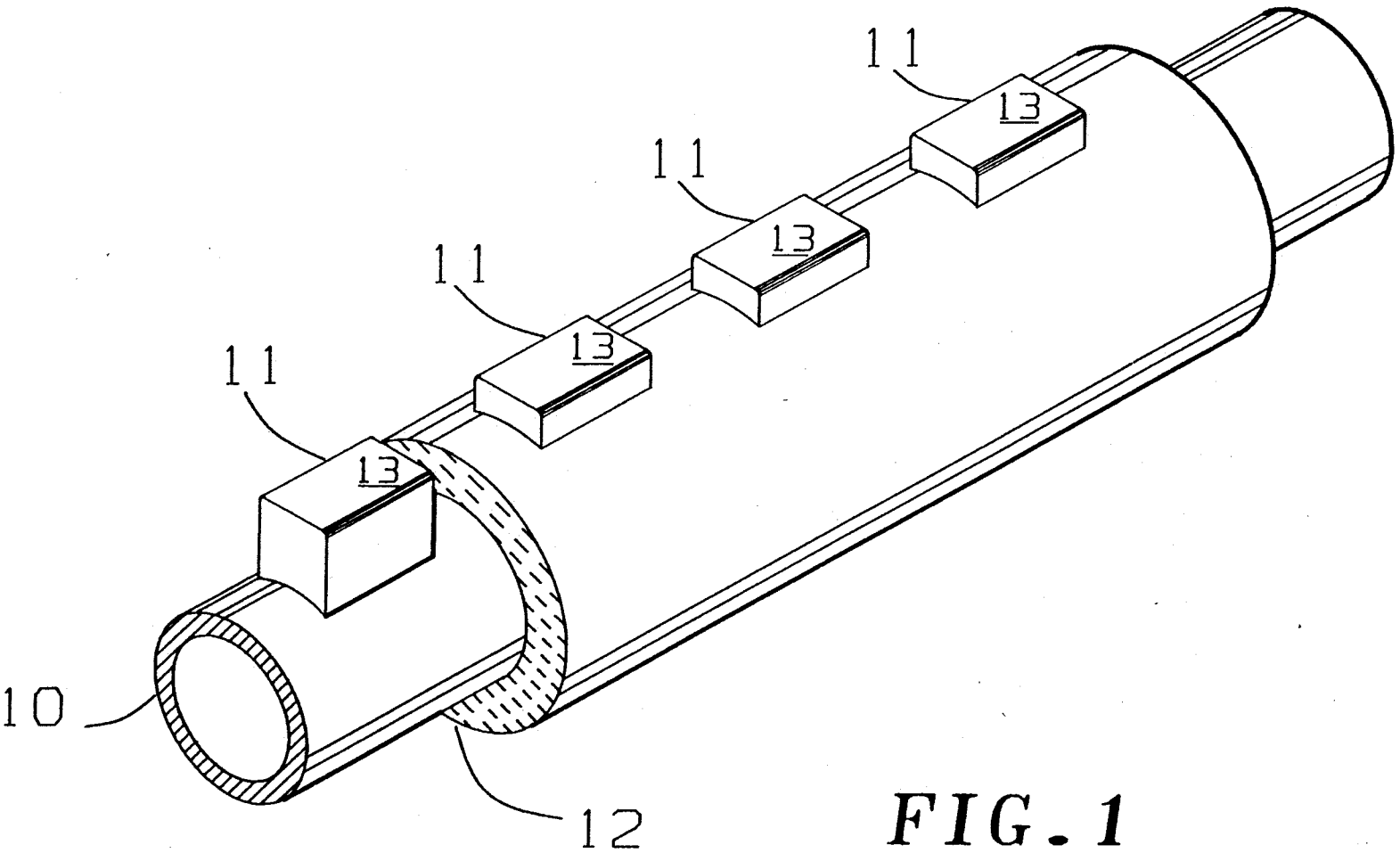
FIG. 1 PRIOR ART
FIG. 1 is a fragmentary perspective illustration of prior art showing a schematic water cooled skid and associated riders and thermal insulation.

A typical assembly of a water cooled tubular skid and rider is illustrated in FIG. 1. A pipe 10 is supported horizontally and lengthwise in a steel reheat furnace by vertical supports (not shown). Multiple riders 11 are secured to the outer surface of the pipe 10, usually by welding, although appropriate metal brackets and cleats may be provided to facilitate replacement of the riders 11. Typically riders 11 are solid blocks of temperature resistant metal such as chrome alloys, nickel alloys and the like (U.S. Pat. Nos. 4,900,248; 4,906,525). The riders normally are solid, tapered, rectangular blocks in order to facilitate withdrawal of heat from the rider through the pipe 10 and the cooling water flowing through the pipe 10. Thermal insulation 12 is normally provided over the pipe 10 and at least the lower portions of the riders 11 in order to reduce the amount of heat loss from the furnace through the pipe 10. Buttons (not shown in FIG. 1) are provided as an alternative to the riders 11 in FIG. 1. Buttons are normally cylindrical or rectangular blocks of temperature resistant metals. The top surfaces 13 of the riders 11 engage the under surface of a steel workpiece in a reheat furnace and are the primary cause of the skid mark phenomenon. The thermal insulation 12 may be applied as a coating or wrapping over the pipe 10 and the base of the riders 11 (U.S. Pat. Nos. 4,428,730; 4,450,872) or may be applied as preformed thermal insulation members (U.S. Pat. Nos. 4,505,303; 4,424,028).

Riders 11 typically are two to six inches high and corresponding buttons are similarly two to six inches high. The pipe 10 is shown as a circular pipe. Non-circular tubular conduits have been proposed for use as water cooled skids in reheat furnaces (U.S. Pat. Nos. 4,275,771; 4,362,506; 4,505,303).

The Skid Mark Phenomenon

Figure 2B:
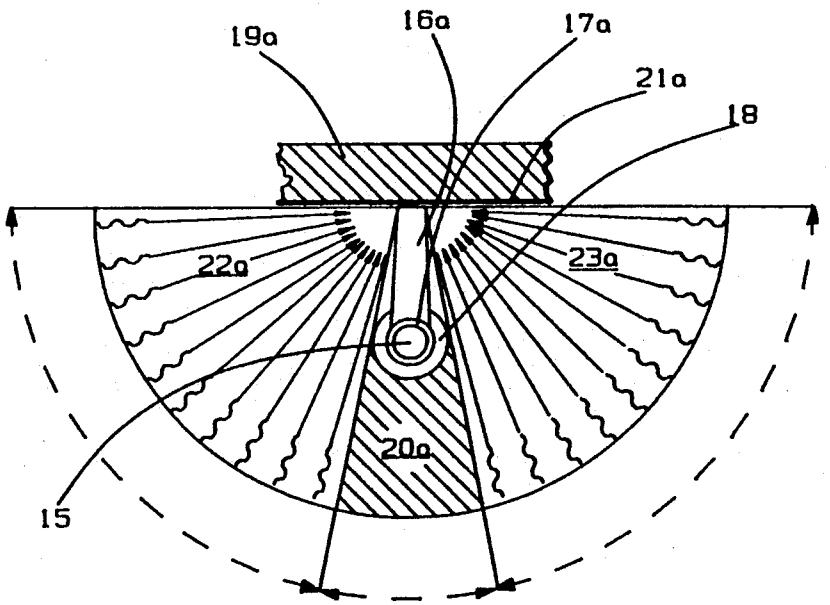
FIGS. 2A and 2B are schematic illustrations showing the radiation thermal distribution differences for a conventional button (FIG. 2A) and for a tall button of this invention (FIG. 2B).
Figure 2A:
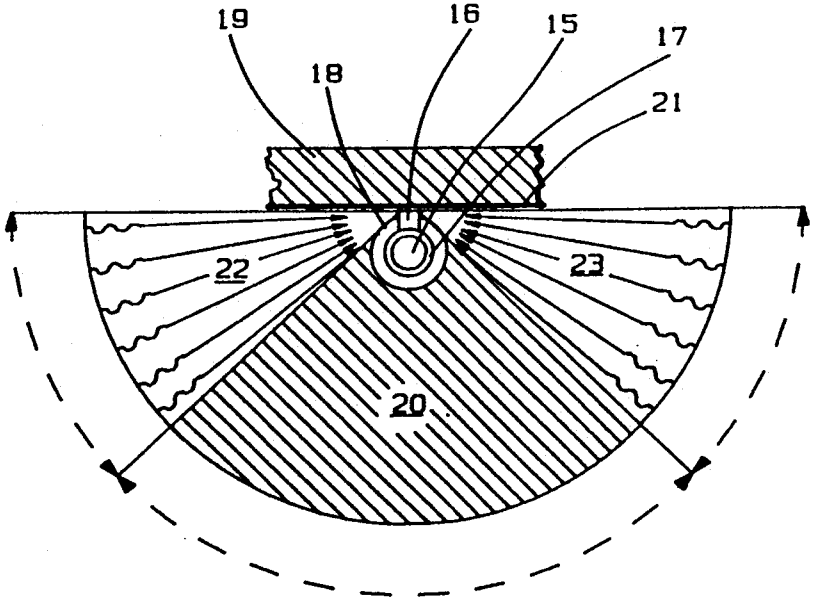

FIG. 2A illustrates a conventional water cooled skid 15 with a conventional rider 16 (or button). The skid 15 is in the form of a circular pipe 17 having peripheral thermal insulation 18. The rider 16 (or button) supports a steel workpiece 19 together with other riders (which are not shown in FIG. 2A). The illustrated skid 15 and rider 16 combination creates a shadow which subtends a shadow angle 20 of 91°. The shadow angle 20 is cross-hatched for clarity of explanation. The under surface 21 of the steel workpiece 19 receives radiant heat through the two unshadowed areas which subtend angles 22, 23 of 44.5° each, totaling 89°. Thus less than one-half of the available radiant energy in the bottom of the reheat furnace is available for release to the under surface 21 of the steel workpiece 19.

The dramatic effect of increasing the height of a rider or button is apparent from FIG. 2B in which corresponding numerals identify corresponding elements. The tall rider **16*a* (or button) supports the under surface 21*a* of a steel workpiece 19*a*. The water cooled skid 15 and tall rider 16*a* present a shadow which subtends an angle 20*a* of 20°. The under surface 21*a* receives radiant heat energy through two unshadowed areas which subtend angles 22*a*, 23*a* of 80°, for a total of 160°. Thus the substitution of a tall rider 16*a* (FIG. 2B) for the conventional rider 16 (FIG. 2A) greatly increases the unshadowed area 22*a*, 23*a* for radiant heat energy application to the under surface 21*a*. The present invention permits the use of tall riders 16*a*** (or buttons) in association with water cooled skids.

Efforts to use tall riders or buttons alone will fail because the wear and compression experienced by the riders or buttons will erode and/or compress the riders or buttons rapidly. The typical materials of construction of riders and buttons will lose strength at the high temperatures which develop in the steel workpieces.

Figure 3:
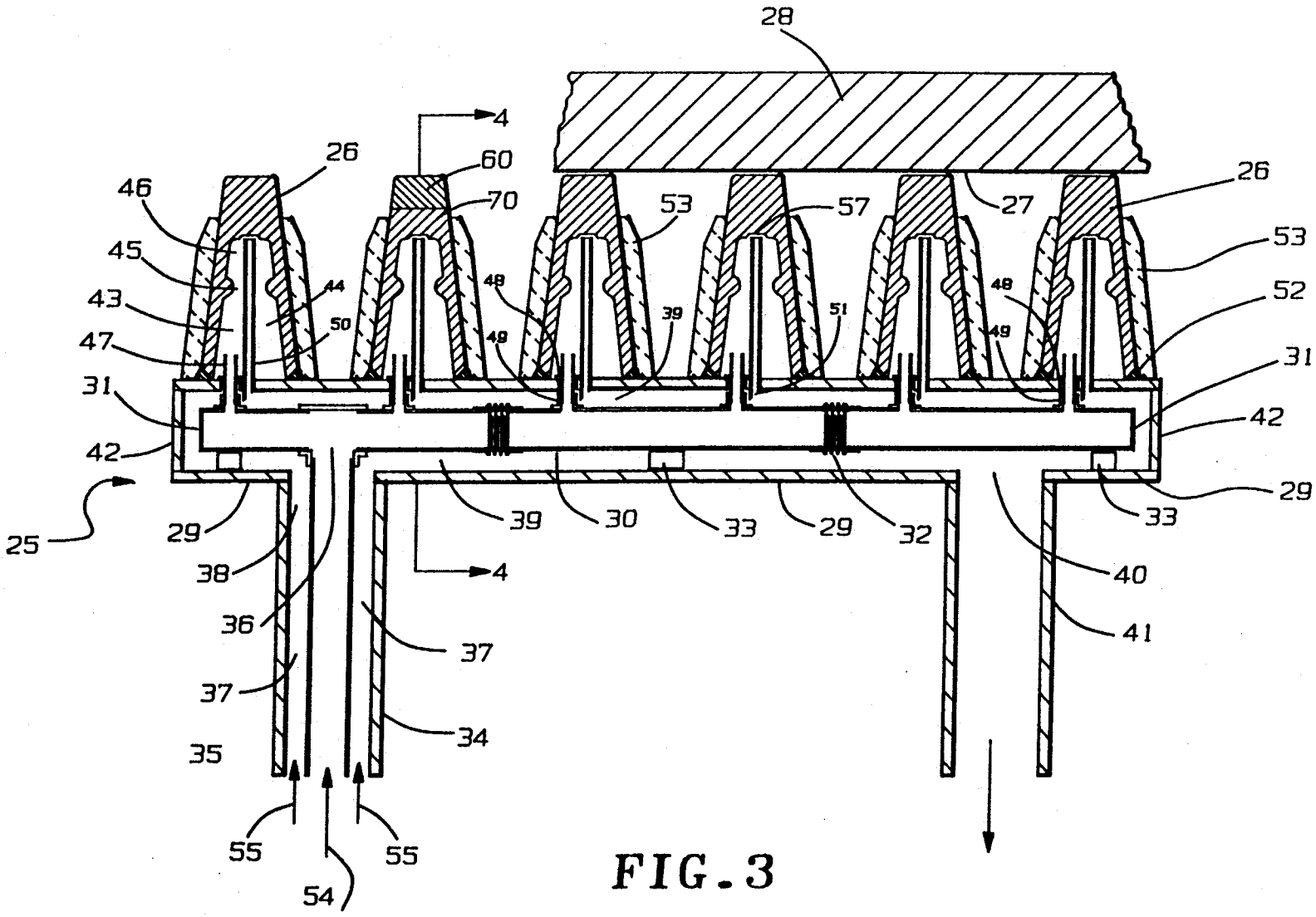
FIG. 3 is a cross-section illustration of a water cooled tubular skid and tall buttons of a preferred embodiment of this invention.

FIG. 3 illustrates a water cooled skid 25 having multiple, spaced-apart buttons 26 which support the under surface 27 of a steel workpiece 28. The water cooled skid 25 comprises a generally horizontal pipe 29 which may be formed from ordinary carbon steel and which is coated over its exposed external surface with appropriate thermal insulation (not shown in FIG. 3). Within the pipe 29 is a centrally positioned conduit 30 having end caps 31 and intermediate bellows or expansion sleeves 32. The central water manifold conduit 30 is maintained in position by means of spacer blocks 33. Preferably the spacer blocks 33 are secured to the conduit 30 and are free to slide over the inner surface of the pipe 29 to accommodate differential thermal expansion.

A generally vertical water delivery pipe 34 has a centrally positioned conduit 35. The centrally positioned conduit 35 communicates with an opening 36 in the central manifold conduit 30. An annulus 37 is provided between the central water manifold conduit 35 and the water delivery pipe 34. The pipe 29 has an opening 38 which communicates with the water delivery pipe 34. The annulus 39 communicates with the annulus 37. The central conduit 35 communicates with the central conduit 30. A second opening 40 is provided in the pipe 29 to receive a water discharge pipe 41 which communicates with the annulus 39. End closures 42 are provided at each end of the pipe 29.

Riders or Buttons

The buttons 26 contain a water-flow passageway 43 including a first chamber 44, a narrowed neck 45 and a second chamber 46. First tubes 47 extend from the first chamber 44 through openings 48 in the pipe 29 and corresponding openings 49 in the central water manifold conduit 30. Second tubes 50 extend from the second chamber 46 through openings 51 in the pipe 29 to communicate with the annulus 39.

The buttons 26 are secured to the pipe 29 by means of welds 52 around the perimeter of the button base. Appropriate thermal insulation 53 surrounds the base of the buttons 26. The thermal insulation 53 may be a pre-cast frusto-conical hollow shape corresponding with the shape of the button 26.

The water delivery pipe 34 and the centrally positioned conduit 35 are preferably vertically presented and serve, in part, as a structural support for the water cooled skid 25.

Operation

A first stream 54 of relatively high pressure water is introduced into conduit 35 and delivered to the central water manifold conduit 30. The water from conduit 30 passes through the first tubes 47 into the first chamber 44, through the neck 45 and into the second chamber 46 of a button 26. Thence the water passes through a second tube 50 into the annulus 39.

A second stream 55 of water is introduced into the annulus 37 and thence into the annulus 39 and is removed from the pipe 29 through the water discharge pipe 41. It should be observed that all of the water from both streams 54, 55 eventually appears in the annulus 39 and is removed through the water discharge conduit 41. The water from the first stream 54 is supplied at an elevated pressure, the highest water pressure in the system. The first stream 54 experiences pressure drops in its transit through the system and continues to have a higher pressure in the second tubes 51 than the water pressure in the annulus 39. The flow rate of water in each of the two streams 54, 55 is regulated to maintain appropriate temperatures in the buttons 26 and to maintain appropriate temperatures in the pipe 29. Preferably the temperatures of the buttons are about 2000° F. or less.

The selected temperature for the buttons should be less than the temperature at which the temperature-deformation (creep) is less than 1 percent over 10,000 hours. That temperature can be determined for the selected material of construction of the buttons.

Figure 4:
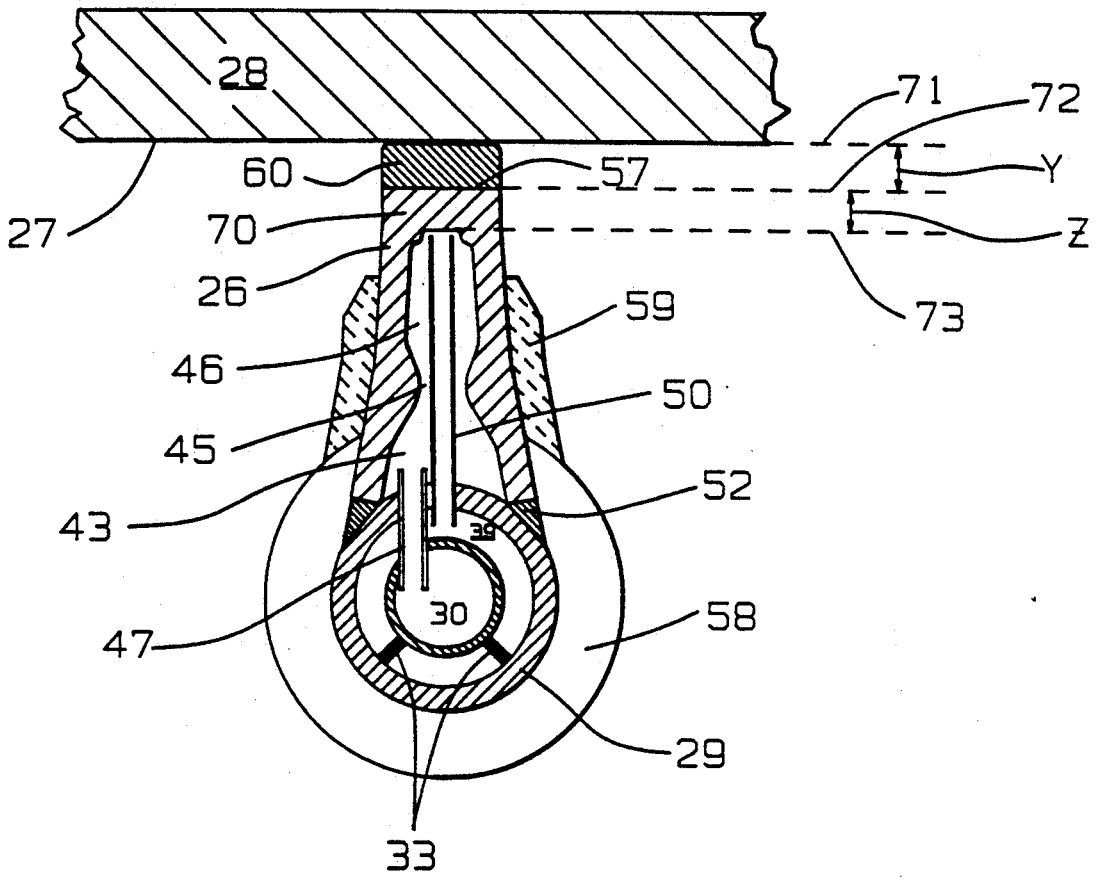
FIG. 4 is a cross-section illustration of a single button and water cooled tubular skid of FIG. 3 taken along the line 4—4 of FIG. 3.

A transverse view of the water cooled skid and button of this invention is presented in FIG. 4 wherein the corresponding numerals identify corresponding elements.

A recess 57 is provided in the top wall of the second chamber 46 at the highest level of said second chamber. The upper end of the second tube 50 is positioned in the recess. This construction tends to reduce the possibility that any air will become entrapped within the liquid flow passageway 43. The neck 45 provides the least cross-sectional area for water-flow through the liquid passageway 43. Accordingly, the cooling water flow rate is maximum in the neck 45.

Thermal insulation may be provided in the form of a cylindrical sleeve 58 or coated insulation. A frusto-conical insulation 59 is applied to the central portion of the button 26.

While a circular cross-section is illustrated for the pipe 29 of FIG. 4, other shapes may be useful, e.g., oval, rectangular, trapezoid (see U.S. Pat. No. 4,505,303). The pipe 29 may have a flat upper surface to facilitate securing the buttons or riders to the pipe.

Materials

The buttons of this invention preferably are formed from temperature-resistant steel alloys which retain significant strength properties at elevated temperatures of a reheat furnace; alloys containing cobalt, nickel, chromium, titanium. See also U.S. Pat. No. 4,900,248. In order to simplify periodic maintenance, it is preferred to have an interchangeable top 60 which will function as the workpiece supporting element and wearing element in the system. The cap 60 may be fabricated from the same alloy or from a different alloy compared to the main body of the button 26. Preferably the caps 60 are formed from superior hot strength alloys and the base of the buttons 26 are formed from lower cost alloys. Mechanically interlocking elements (not shown) may be provided to secure the tops 60 to the supporting portion of the button 26.

The buttons 26 which are illustrated in FIGS. 3 and 4 are intended for use in walking beam furnaces on the fixed skids and also on the walking skids.

Figure 5:
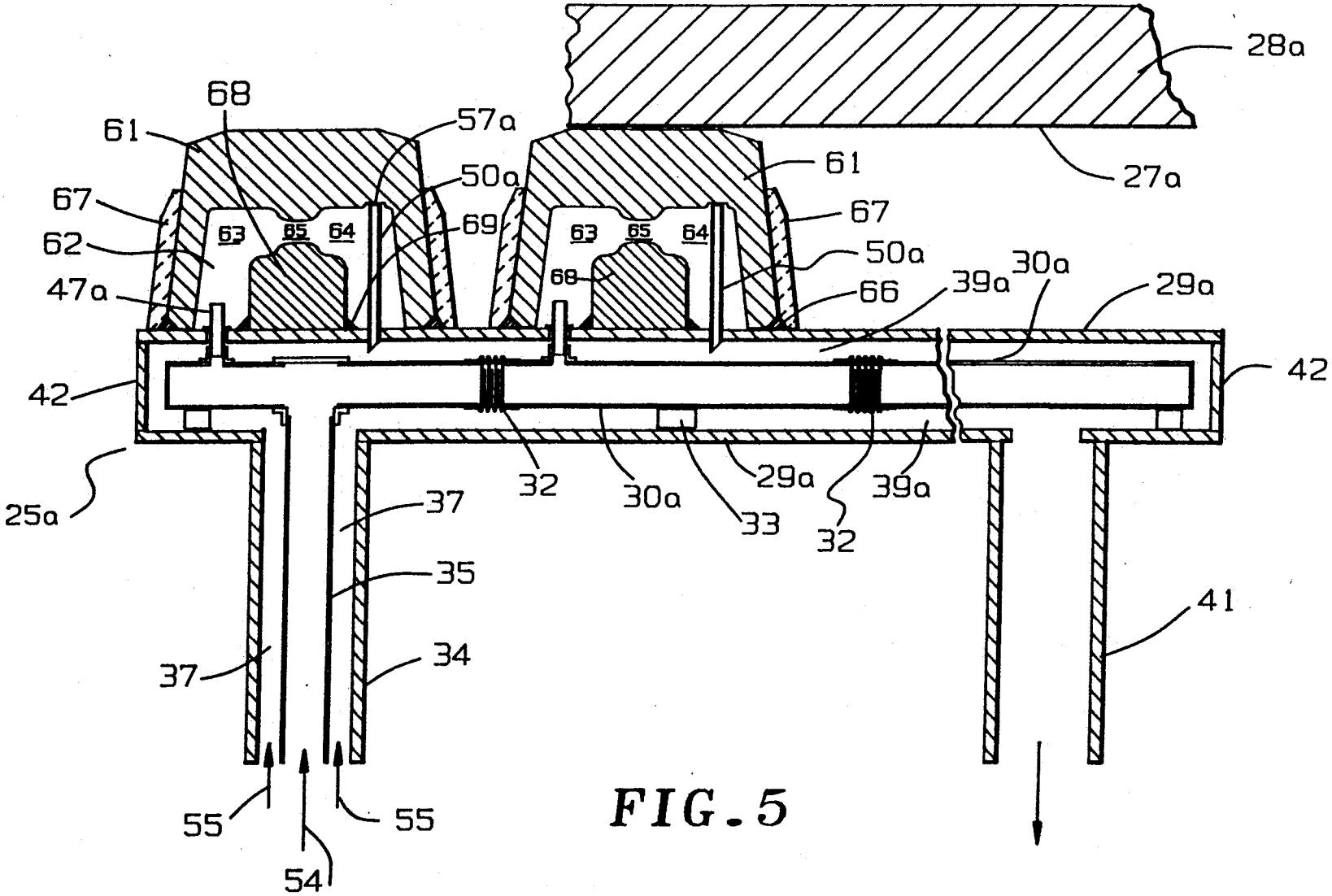
FIG. 5 is a cross-section illustration, similar to a portion of FIG. 3, illustrating tall riders and the associated water cooled tubular skid for use in a pusher reheat furnace.

Water cooled skids with tall riders for use in pusher furnaces and in composite furnaces are illustrated in FIG. 5 wherein corresponding numerals indicate corresponding elements. The principal difference is that the rider 61 has a fluid flow passageway 62 having a first chamber 63 separated laterally from a second chamber 64 by means of a neck 65. A recess 57*a* is provided in the ceiling of the second chamber 64 at the highest level of the second chamber. The upper end of the second tube 50*a* is positioned within the recess 57*a* to preclude any air bubbles in the flow passageway 62. The riders are secured to the pipe 29 by means of appropriate welds 66. Appropriate thermal insulation 67 is provided over the buttom portion of the rider 61. The riders may include an independent block 68 which is secured to the pipe 29 by means of appropriate welds 69. The block 68 and a hollow rider 61 cooperate to define the water-flow passageway 62. There are two supplies of water 54, 55. High pressure water is delivered at 54 through the central conduit 35 and into the central conduit 30 for release through first tubes 47*a* into the first passageway 63, the neck 65, the second passageway 64 and the second tube 50*a*, to the annulus 39*a*, whence the water is discharged through the discharge pipe 41. A second water stream 55 is delivered into the annulus 37 thence into the annulus 39*a* for discharge through the discharge pipe 41*a*.

A typical reheat furnace contains a minimum of two skids and may contain up to an appropriate number of skids across the width of the furnace, e.g., up to 15 or 20. Skids are provided in one or more lengthwise sets, typically from 1 to 5 sets. Each set is from 30 to 80 feet long. The tall buttons preferably are 8 to 12 inches, i.e., above the skid. Taller buttons, e.g., more than 12 inches, may be provided for the fixed skid and less tall buttons, e.g., 6 to 8 inches, may be provided for the walking skids.

Typical riders will be 12 to 15 inches long, 8 to 12 inches high, about 4 inches wide at the top and about 5 inches wide at the base. Typical water-cooled pipes for skids are 4 to 8 inches in diameter. The skid pipes may have shapes which are non-circular in cross-section.

Design of Buttons, Riders

Buttons or riders in the initial region of a reheat furnace can be made taller than conventional buttons or riders without requiring water-cooling features. The workpiece in the initial region of a reheat furnace is increasing in temperature from ambient temperature to some intermediate temperature, e.g., 800° to about 1500° F. Such intermediate temperatures do not present serious concerns about the creep resistance of relatively inexpensive steel alloys from which the initial region buttons or riders may be formed. The taller buttons or riders in the initial region of a furnace will present less shielding of radiation to a supported workpiece and thus will permit more radiant energy to strike the undersurface of a workpiece than the commonly-used low buttons and riders.

In the final regions of a reheat furnace, the workpiece approaches its intended discharge temperature and the tall buttons or riders require materials of construction which present appropriate creep resistance at the existing elevated temperatures.

Ideally the top surface of the tall buttons or riders should approach the interface discharge temperature of the supported workpiece so that the tendency of the button or rider to receive conductive heat from the supported workpiece is nearly eliminated, thereby nearly eliminating the skid mark phenomenon in the workpiece. The goal of approaching the desired discharge temperature at the workpiece/button (rider) interface must be balanced by the need to maintain adequate creep resistance in the button or rider. Creep resistance decreases with increasing temperature. The two-piece button of FIG. 4 provides a preferred structure for buttons which are employed to support workpieces at temperatures of 2200° F. and higher. The two-piece button 26 has a replacement top 60 secured to the body portion 70 of the button, preferably by keying, cleating or other mechanical connections. The broken lines 71, 72, 73 indicate respectively:

71—the interface between the replacement top 60 and the undersurface 27 of the supported workpiece 28;

72—the interface between the replacement top 60 and the body portion 70 of the button 26; and 73—the interface between the body portion 70 and the top of the chamber 46 which contains cooling water.

In a preferred design the temperature at the line 71 is very close to the temperature of the undersurface 27 of the workpiece, which may be 2000° F. to 2600° F., for example. The temperature at the line 73 is about 400° F. The flow rate of cooling water will be regulated to maintain the desired temperature at the line 73. NOTE: While the interface at 73 is perhaps 400° F. on the metal side, the temperature on the water side is maintained below a boiling temperature.

An intermediate temperature will develop along the line 72 in accordance with the thermal conductivity at the interface between the replacement top 60 and the body portion 70. The height of the replacement top 60, between the lines 71, 72 is indicated by the dimension arrows Y. The height of the body portion 70 between the lines 72, 73 is indicated by the dimension arrows Z. The distance Y s about 2 to 4 inches. In elevated temperature furnaces, the replacement top 60 may be fabricated from a selected cobalt alloy which will provide adequate creep resistance at the intended workpiece discharge temperature. The desired creep resistance of the metal at the operating temperature should be less than 1% deformation in 10,000 hours exposure.

We claim:

1. In a heating furnace for steel workpieces having generally horizontal, lengthwise support skids comprising a pipe with water flowing therethrough, and a plurality of spaced-apart workpiece-supporting members comprising riders or buttons secured to said pipe, the improvement comprising:

each of said workpiece-supporting members having a fluid-flow passageway therein, and means to transfer water to and from said fluid-flow passageway; said pipe having a water manifold conduit therein, said water manifold conduit having a first opening for receiving water an having multiple second openings, an annular flow passageway between said water manifold conduit and said pipe, a water-delivery tube extending through the outer wall of said pipe and connecting each of said second openings to said fluid-flow passageway of a workpiece-supporting member; a water recovery tube extending through the outer wall of said pipe from said fluid-flow passageway of said workpiece-supporting member to communicate with said annular flow passageway and means to introduce water into and to recover water from said annular flow passageway.

2. The improvement of claim 1 wherein said fluid flow passageway has a first fluid chamber and a second fluid chamber and a connecting fluid passageway which has a smaller cross-sectional area that either of the two said chambers, whereby water accelerates in flowing through said connecting fluid passageway.

3. The improvement of claim 2 wherein the said workpiece-supporting member is a button and the said first fluid chamber is in the bottom portion of said button, the said second chamber is in the top portion of said button and said connecting fluid passageway is in the intermediate portion of said button.

4. The improvement of claim 3 wherein said second fluid chamber has an interior roof and a recessed portion in said roof, at the highest level thereof, and said water recovery tube has an upper open-end disposed within said recess.

5. The improvement of claim 1 wherein said water manifold conduit has at least one expansion joint between its ends.

6. The improvement of claim 2 wherein said workpiece supporting member is a rider and said first fluid chamber is horizontally spaced from said second fluid chamber and said connecting fluid passageway accommodates horizontal flow of water from said first chamber to said second chamber.

7. The improvement of claim 6 wherein said second chamber has an interior roof and a recessed portion in said interior roof at the highest level thereof, and said water recovery tube has an upper end disposed within said recess.

8. The improvement of claim 1 including two sources of water, of which a first source at a first pressure is connected to said fluid flow passageway to deliver cooling water to said support members; a second source at a second pressure is connected to said pipe to deliver cooling water for said pipe; and means for withdrawing all water from said pipe, said first pressure being greater than said second pressure.

* * * * *